US008430081B2

(12) United States Patent
Mancini et al.

(10) Patent No.: US 8,430,081 B2
(45) Date of Patent: Apr. 30, 2013

(54) DIRECT-INJECTION SYSTEM FUEL PUMP WITH A MAXIMUM-PRESSURE VALVE

(75) Inventors: Luca Mancini, Budrio (IT); Daniele De Vita, Castel San Pietro Terme (IT); Massimo Mattioli, Calderara di Reno (IT)

(73) Assignee: Magneti Marelli S.p.A., Corbetta (IT)

( * ) Notice: Subject to any disclaimer, the term of this patent is extended or adjusted under 35 U.S.C. 154(b) by 518 days.

(21) Appl. No.: 12/749,131

(22) Filed: Mar. 29, 2010

(65) Prior Publication Data

US 2010/0242922 A1 Sep. 30, 2010

(30) Foreign Application Priority Data

Mar. 30, 2009 (IT) ..... BO2009A0198

(51) Int. Cl.
*F02M 57/02* (2006.01)
*F04B 49/03* (2006.01)

(52) U.S. Cl.
USPC ..... 123/446; 123/457; 123/506; 417/311

(58) Field of Classification Search ..... 123/446, 123/447, 467, 506, 510, 511, 514; 137/539.5; 417/307, 309, 311
See application file for complete search history.

(56) References Cited

U.S. PATENT DOCUMENTS

| | | | | | |
|---|---|---|---|---|---|
| 2,969,084 | A | * | 1/1961 | Raymond | 137/471 |
| 3,003,423 | A | * | 10/1961 | Drutchas | 417/300 |
| 3,799,194 | A | * | 3/1974 | Bedo et al. | 137/539.5 |
| 4,310,018 | A | * | 1/1982 | Parr et al. | 137/539.5 |
| 4,509,491 | A | * | 4/1985 | Kawatei | 123/502 |
| 4,893,650 | A | * | 1/1990 | Chisholm et al. | 137/539 |
| 4,905,729 | A | * | 3/1990 | Kawamura | 137/539.5 |
| 5,015,160 | A | * | 5/1991 | Hlousek et al. | 417/499 |
| 5,295,469 | A | * | 3/1994 | Kariya et al. | 123/456 |
| 5,394,840 | A | * | 3/1995 | Phelps | 123/73 C |
| 5,735,250 | A | * | 4/1998 | Rembold et al. | 123/504 |
| 5,950,669 | A | * | 9/1999 | Fehlmann et al. | 137/493.3 |
| 6,045,120 | A | * | 4/2000 | Tarr et al. | 251/282 |
| 6,095,774 | A | * | 8/2000 | Tanaka et al. | 417/540 |
| 6,125,822 | A | * | 10/2000 | Janik et al. | 123/457 |
| 6,209,527 | B1 | * | 4/2001 | Bueser et al. | 123/514 |
| 6,244,253 | B1 | * | 6/2001 | Haeberer et al. | 123/514 |
| 6,675,823 | B2 | * | 1/2004 | Guo et al. | 137/115.04 |
| 7,401,593 | B2 | * | 7/2008 | Rembold et al. | 123/467 |
| 7,677,872 | B2 | | 3/2010 | Beardmore | |

(Continued)

FOREIGN PATENT DOCUMENTS

| | | | |
|---|---|---|---|
| DE | 10 2007 000 293 | A1 | 11/2007 |
| DE | 10 2008 045 730 | A1 | 3/2009 |
| EP | 1 365 142 | B1 | 7/2007 |
| EP | 1 898 084 | A1 | 3/2008 |

*Primary Examiner* — Thomas Moulis
(74) *Attorney, Agent, or Firm* — Workman Nydegger

(57) ABSTRACT

A direct-injection system fuel pump having: at least one pumping chamber; a piston mounted to slide inside the pumping chamber to cyclically alter the volume of the pumping chamber; an intake channel connected to the pumping chamber and regulated by an intake valve; a delivery channel connected to the pumping chamber and regulated by a one-way delivery valve that only permits fuel flow from the pumping chamber; and a drain channel regulated by a one-way, maximum-pressure valve, which opens when the fuel pressure in the drain channel exceeds a threshold value, and which has a shutter movable along the drain channel, a valve seat engaged in fluidtight manner by the shutter, and a spring calibrated to push the shutter into a position engaging the valve seat in fluidtight manner.

19 Claims, 3 Drawing Sheets

U.S. PATENT DOCUMENTS

2002/0062817 A1* 5/2002 Endo ..... 123/467
2006/0196476 A1* 9/2006 Stockner ..... 123/457
2006/0228239 A1* 10/2006 Usui et al. ..... 417/470
2006/0275166 A1* 12/2006 Mattioli et al. ..... 417/571
2007/0110603 A1* 5/2007 Usui et al. ..... 417/505
2007/0286742 A1 12/2007 Inoue
2008/0056914 A1* 3/2008 Usui et al. ..... 417/307
2009/0252621 A1* 10/2009 Siegel et al. ..... 417/307

* cited by examiner

DIRECT-INJECTION SYSTEM FUEL PUMP WITH A MAXIMUM-PRESSURE VALVE

TECHNICAL FIELD

The present invention relates to a direct-injection system fuel pump.

BACKGROUND ART

A direct-injection system comprises a number of injectors; a common rail, which feeds pressurized fuel to the injectors; a high-pressure pump, which feeds fuel to the common rail along a feed line, and has a flow regulating device; and a control unit, which controls the flow regulating device to maintain a desired fuel pressure in the common rail, which normally varies as a function of engine operating conditions.

The high-pressure pump comprises at least one pumping chamber, in which a piston slides back and forth; an intake pipe regulated by an intake valve to feed low-pressure fuel to the pumping chamber; and a delivery pipe regulated by a delivery valve to feed high-pressure fuel from the pumping chamber along the feed line to the common rail. The flow regulating device normally acts on the intake valve to also keep it open during the pumping stage, so that a varying amount of fuel in the pumping chamber flows back into the intake pipe, as opposed to being pumped along the feed line to the common rail.

It has recently been proposed to form a drain channel in the high-pressure pump, connecting the delivery pipe to the pumping chamber, and regulated by a one-way maximum-pressure valve, which only allows fuel flow from the delivery pipe to the pumping chamber, and serves as a fuel bleed valve, in the event the fuel in the common rail exceeds a maximum design pressure (typically as a result of control errors by the control unit). In other words, the maximum-pressure valve is calibrated to open automatically when the difference between the pressures on either side of it exceeds a design threshold value, and so prevent the fuel in the common rail from exceeding the maximum design pressure.

The maximum-pressure valve normally comprises a ball shutter movable along the drain channel; and a valve seat engaged in fluidtight manner by the shutter. A calibrated spring pushes the shutter into a position engaging the valve seat in fluidtight manner; and the elastic pressure of the spring is calibrated so the shutter only detaches from the valve seat when the difference between the pressures on either side of the maximum-pressure valve exceeds the design threshold value.

Fuel flow along the drain channel, when the maximum-pressure valve opens, varies, depending on engine speed, i.e. depending on flow from the high-pressure pump, the actuating frequency of which is directly proportional to engine speed. In other words, in the event of a high flow rate from the high-pressure pump, it feeds a large amount of fuel to the common rail, and, if the fuel pressure in the common rail is too high, a correspondingly large amount of fuel must be drained from the common rail along the drain channel.

For a large amount of fuel to flow along the drain channel, the maximum-pressure valve needs a large flow opening, which means the shutter must move a good distance away from the valve seat, thus exerting greater pressure on the spring. Conversely, for a small amount of fuel to flow along the drain channel, the maximum-pressure valve only needs a small flow opening, which means the shutter need only move a small distance away from the valve seat, thus exerting less pressure on the spring. In other words, an increase in fuel flow along the drain channel calls for a proportional increase in the size of the flow opening of the maximum-pressure valve, and therefore a proportional increase in the movement of the shutter, greater pressure on the spring, and greater elastic pressure by the spring on the shutter. The increase in the elastic pressure of the spring on the shutter inevitably calls for greater fuel pressure in the common rail, since, to keep the valve open, the hydraulic pressure exerted on the shutter by the fuel pressure must equal the elastic pressure exerted on the shutter by the spring.

Put briefly, at low engine speed (i.e. with a low flow rate from the high-pressure pump), the maximum fuel pressure in the common rail is lower, whereas, at high engine speed (i.e. with a high flow rate from the high-pressure pump), the maximum fuel pressure in the common rail is higher. The increase in the maximum fuel pressure in the common rail alongside an increase in engine speed is by no means negligible, and may even be as much as 50% of the maximum fuel pressure at idling speed.

To allow for the increase in maximum fuel pressure in the common rail alongside an increase in engine speed, all the component parts (pipes, common rail, pressure sensor, and above all the injectors) must be designed to safely withstand the maximum possible fuel pressure in the common rail, despite this affording no advantages in terms of operation. Oversizing the component parts affected by the increase in maximum fuel pressure in the common rail alongside an increase in engine speed obviously means a considerable increase in cost and weight (stronger components are necessarily heavier), that affords no functional advantage.

US2007286742A1 discloses a direct-injection system fuel pump having: at least one pumping chamber; a piston mounted to slide inside the pumping chamber to cyclically alter the volume of the pumping chamber; an intake channel connected to the pumping chamber and regulated by an intake valve; a delivery channel connected to the pumping chamber and regulated by a one-way delivery valve that only permits fuel flow from the pumping chamber; and a drain channel regulated by a one-way, maximum-pressure valve, which opens when the fuel pressure in the drain channel exceeds a threshold value, and which has a shutter movable along the drain channel, a valve seat engaged in fluidtight manner by the shutter, and a spring calibrated to push the shutter into a position engaging the valve seat in fluidtight manner.

DISCLOSURE OF THE INVENTION

It is an object of the present invention to provide a direct-injection system fuel pump designed to eliminate the above drawbacks, and which at the same time is cheap and easy to produce.

According to the present invention, there is provided a direct-injection system fuel pump as claimed in the attached Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
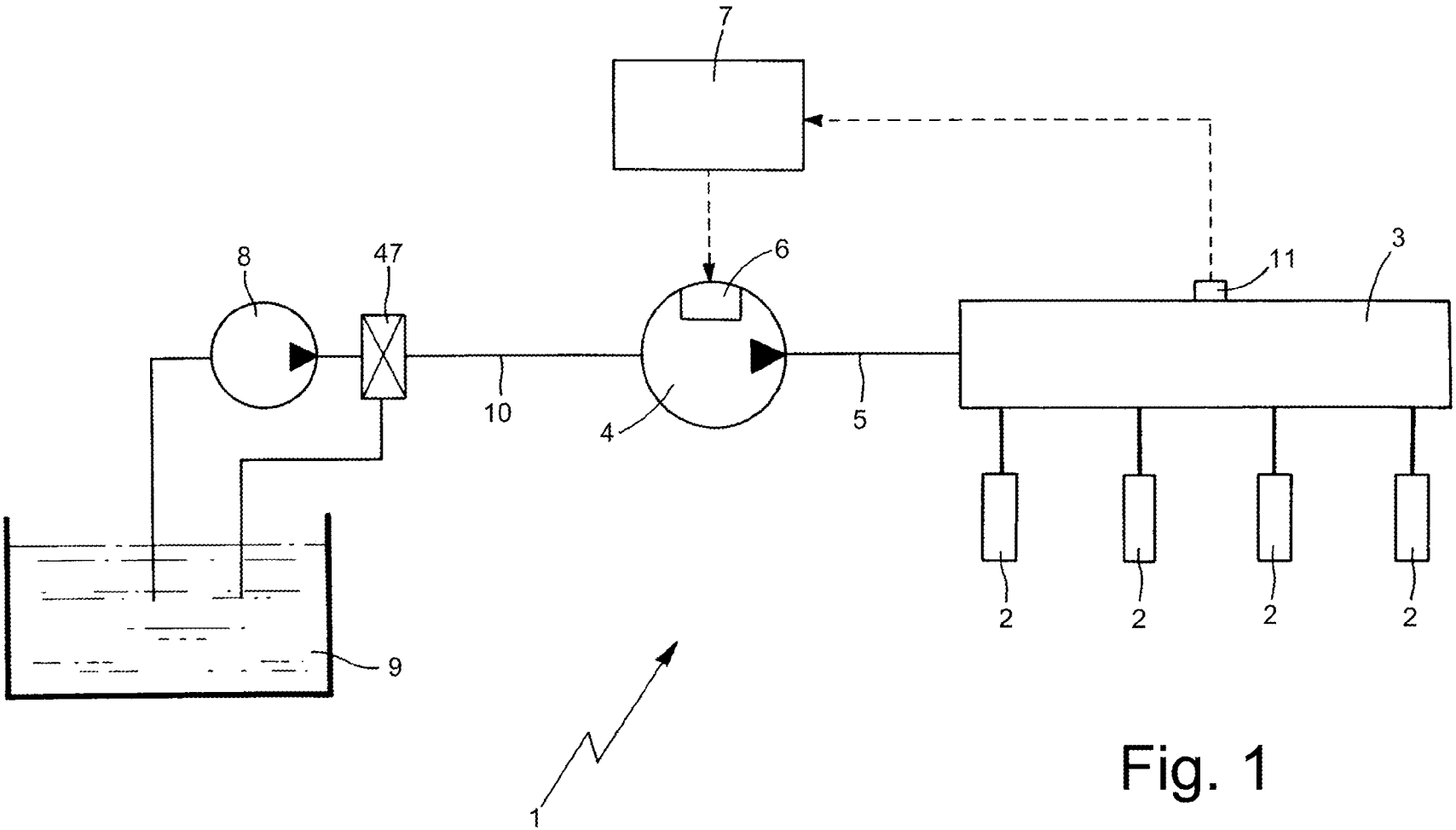
FIG. 1 shows a schematic, with parts removed for clarity, of a common-rail, direct fuel injection system.

Number 1 in FIG. 1 indicates as a whole a common-rail, direct fuel injection system of an internal combustion engine.

Direct-injection system 1 comprises a number of injectors 2; a common rail 3, which feeds pressurized fuel to injectors 2; a high-pressure pump 4, which feeds fuel to common rail 3 along a feed line 5, and has a flow regulating device 6; a control unit 7 for maintaining a desired fuel pressure in common rail 3, which normally varies as a function of engine operating conditions; and a low-pressure pump 8, which feeds fuel from a tank 9 to high-pressure pump 4 along a feed line 10.

Control unit 7 is connected to regulating device 6 to control flow from high-pressure pump 4, so that common rail 3 is supplied at all times with the amount of fuel necessary to maintain the desired pressure in common rail 3. More specifically, control unit 7 regulates the flow of high-pressure pump 4 by feedback control, using as a feedback variable the fuel pressure inside common rail 3, and as determined in real time by a pressure sensor 11.

Figure 2:
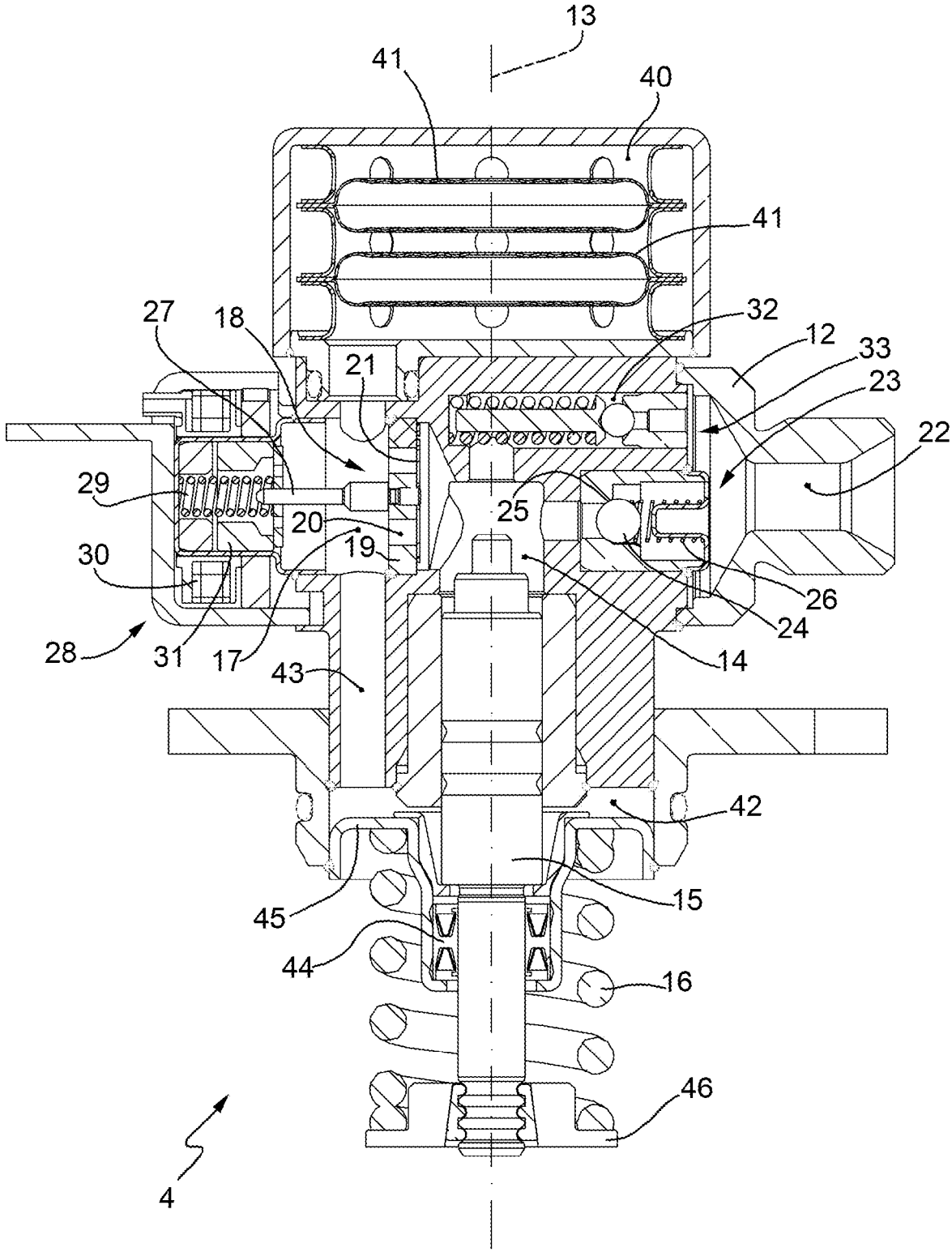
FIG. 2 shows a schematic section, with parts removed for clarity, of a high-pressure fuel pump of the FIG. 1 direct-injection system and in accordance with the present invention.

As shown in FIG. 2, high-pressure pump 4 comprises a main body 12 having a longitudinal axis 13 and defining an inner cylindrical pumping chamber 14. A piston 15 is mounted and slides inside pumping chamber 14, and, as it slides back and forth along longitudinal axis 13, produces a cyclic variation in the volume of pumping chamber 14. A bottom portion of piston 15 is connected on one side to a spring 16, which pushes piston 15 into a position producing a maximum volume of pumping chamber 14, and is connected on the other side to a cam (not shown), which is rotated by a drive shaft of the engine to move piston 15 cyclically upwards and compress spring 16.

An intake channel 17 extends from a lateral wall of pumping chamber 14, is connected by feed line 10 to low-pressure pump 8, and is regulated by an intake valve 18 located at pumping chamber 14. Intake valve comprises a disk 19 having a number of through holes 20, through which fuel can flow; and a deformable circular plate 21 that rests on one face of disk 19 to cut off passage through holes 20. Intake valve 18 is normally pressure-controlled and, in the absence of external intervention, is closed when the fuel pressure in pumping chamber 14 is higher than the fuel pressure in intake channel 17, and is open when the fuel pressure in pumping chamber 14 is lower than the fuel pressure in intake channel 17. More specifically, when fuel flows to pumping chamber 14, plate 21 is deformed and detached from disk 19 by the fuel, which thus flows through holes 20. Conversely, when fuel flows from pumping chamber 14, plate 21 is pressed against disk 19, thus sealing, and preventing fuel flow through, holes 20.

A delivery channel 22 extends from a lateral wall of pumping chamber 14 on the opposite side to intake channel 17, is connected to common rail 3 by feed line 5, and is regulated by a one-way delivery valve 23 located at pumping chamber 14, and which only allows fuel flow from pumping chamber 14.

Delivery valve 23 comprises a ball shutter 24 movable along delivery channel 22; and a valve seat 25, which is engaged in fluidtight manner by shutter 24, and located at the end of delivery channel 22 communicating with pumping chamber 14. A calibrated spring 26 pushes shutter 24 into a position engaging valve seat 25 in fluidtight manner. Delivery valve 23 is pressure-controlled, in that the pressures produced by differences between the pressures on either side of delivery valve 23 are much greater than the pressure exerted by spring 26. More specifically, delivery valve 23 is open when the fuel pressure in pumping chamber 14 is higher than the fuel pressure in delivery channel 22, and is closed when the fuel pressure in pumping chamber 14 is lower than the fuel pressure in delivery channel 22.

Regulating device 6 is connected to intake valve 18, so control unit 7 can keep intake valve 18 open while piston 15 is pumping, and so allow fuel outflow from pumping chamber 14 along intake channel 17. Regulating device 6 comprises a control rod 27, which is connected to plate 21 of intake valve 18 through a central hole in disk 19, and is movable between a passive position allowing plate 21 to engage disk 19 in fluidtight manner to seal holes 20, and an active position preventing the plate from engaging disk 19 in fluidtight manner, thus opening holes 20. Regulating device 6 also comprises an electromagnetic actuator 28 connected to control rod 27 to move it between the active and passive positions. Electromagnetic actuator 28 comprises a spring 29 for holding control rod 27 in the active position; and an electromagnet 30 controlled by control unit 7 to move control rod 27 into the passive position by magnetically attracting a ferromagnetic armature 31 integral with control rod 27. More specifically, when electromagnet 30 is energized, control rod 27 is moved back into the passive position, thus closing intake valve 18 and cutting off communication between intake channel 17 and pumping chamber 14.

A drain channel 32 extends from a top wall of pumping chamber 14, connects pumping chamber 14 to delivery channel 22, and is regulated by a one-way maximum-pressure valve 33 that only allows fuel flow to pumping chamber 14, and which serves as a fuel bleed valve in the event the fuel in common rail 3 exceeds a given maximum design pressure (typically as a result of control errors by control unit 7). In other words, maximum-pressure valve 33 is calibrated to open automatically when the difference between the pressures on either side of it exceeds a design threshold value, and so prevent the fuel in common rail 3 from exceeding the maximum design pressure.

Figure 3:
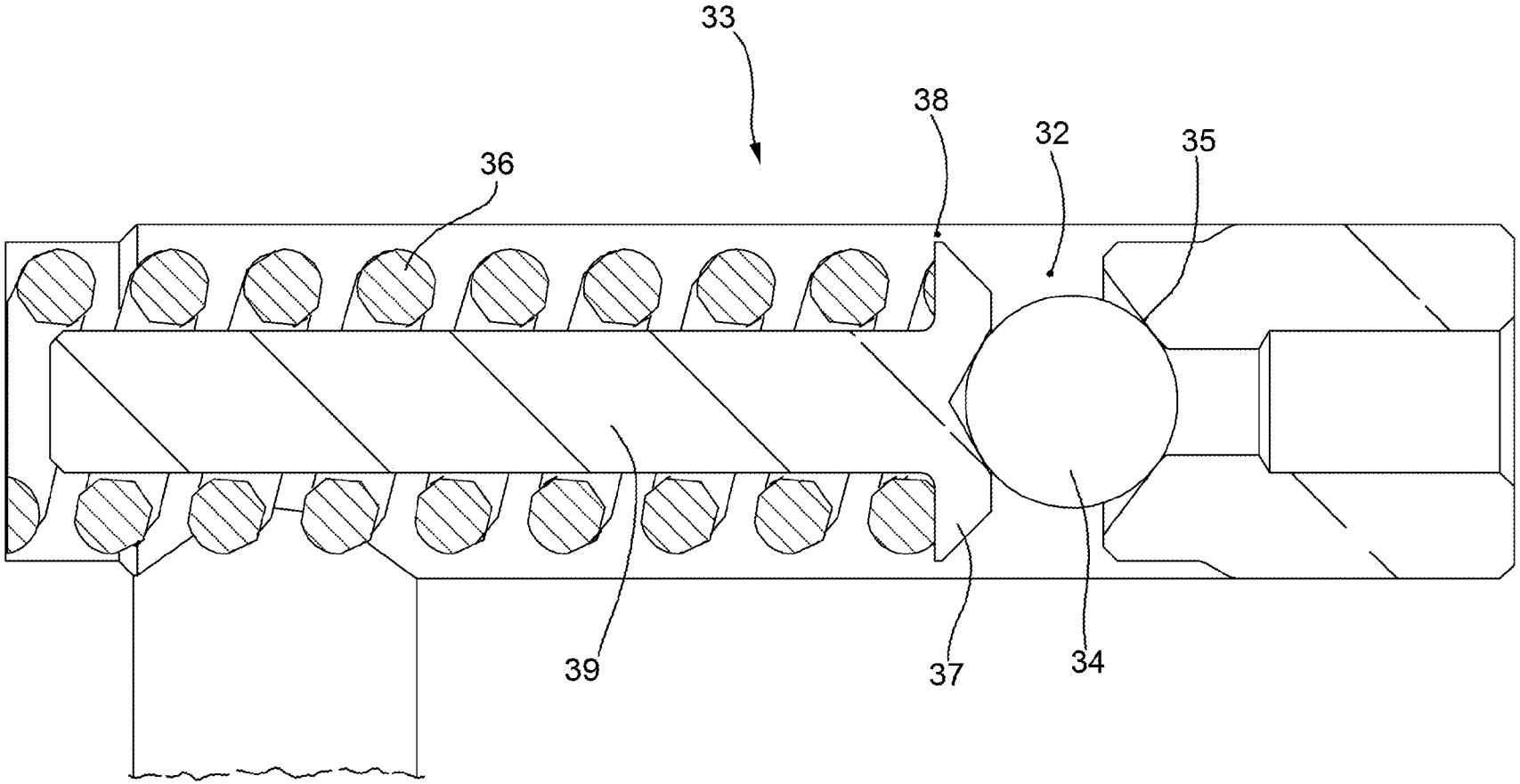
FIG. 3 shows a larger-scale view of a maximum-pressure valve of the FIG. 2 high-pressure fuel pump.

As shown in FIG. 3, maximum-pressure valve 33 comprises a ball shutter 34 movable along drain channel 32; and a valve seat 35 engaged in fluidtight manner by shutter 34. A calibrated spring 36 pushes shutter 34 into a position engaging valve seat 35 in fluidtight manner; and the elastic pressure of spring is calibrated so that shutter 34 only detaches from valve seat 35 when the difference between the pressures on either side of maximum-pressure valve 33 exceeds the design threshold value.

Maximum-pressure valve 33 also comprises a calibrated plate 37, which locally reduces the fuel flow section 38 of drain channel 32. The size (i.e. diameter and length) of calibrated plate 37 is designed to form an annular fuel flow section 38 of a given small area at calibrated plate 27. In the FIG. 3 embodiment, calibrated plate 37 is interposed between one end of spring 36 and one side of shutter 34, and rests on both shutter 34 and spring 36. More specifically, calibrated plate 37 has a rod 39, which is integral with calibrated plate 37, is inserted inside spring 36, and serves both to prevent unwanted rotation of plate 37, and as a limit stop defining the maximum opening movement of shutter 34 (i.e. the opening movement of shutter 34 is arrested when the end of rod 39 opposite plate 37 comes to rest against the end wall of drain channel 32). In a different embodiment not shown, calibrated plate 37 is integral with (e.g. welded to) shutter 34 or spring 36, and may therefore not even be interposed between shutter 34 and spring 36.

When maximum-pressure valve 33 is opened by excessive fuel pressure in common rail 3, a significant load loss occurs locally at the constriction in flow section 38 produced by calibrated plate 37, and produces a corresponding difference between the pressures upstream and downstream from calibrated plate 37 (i.e. fuel pressure is much higher upstream than downstream from calibrated plate 37). This difference in pressure exerts on calibrated plate 37 (and therefore on spring 36 resting on calibrated plate 37) a hydraulic pressure that further compresses spring 36 and so assists in opening maximum-pressure valve 33.

It is important to note that the local load loss astride calibrated plate 37 is not constant, but proportional to the amount of fuel flowing along drain channel 32. That is, an increase in fuel flow along drain channel 32 is accompanied by a proportional increase in the local load loss astride calibrated plate 37, and therefore in the hydraulic pressure exerted on calibrated plate 37 and further compressing spring 36.

By appropriately sizing calibrated plate 37 (i.e. its length and its diameter), the hydraulic pressure exerted on calibrated plate 37 and produced by the load loss astride calibrated plate 37 can be made to roughly equal the increase in elastic pressure of spring 36 caused by inevitable compression of spring 36 as maximum-pressure valve 33 opens. As the opening, i.e. the distance between shutter 34 and valve seat 35, of maximum-pressure valve 33 increases, the elastic pressure of spring 36 therefore increases gradually, due to the gradual increase in compression of spring 36, but at the same time the hydraulic pressure exerted on calibrated plate 37 and produced by the load loss astride calibrated plate 37 also increases gradually, due to the increase in fuel flow along drain channel 32. Since the hydraulic pressure on calibrated plate 37 is exerted in the opposite direction to the elastic pressure of spring 36, the gradual increase in elastic pressure of spring 36 is compensated by the gradual increase in hydraulic pressure on calibrated plate 37, with the result that the total thrust on shutter 34 remains roughly constant as the opening, i.e. the distance between shutter 34 and valve seat 35, of maximum-pressure valve 33 increases, and therefore the fuel pressure downstream from maximum-pressure valve 33, i.e. in feed line 10 and common rail 3, also remains constant.

Put briefly, by means of calibrated plate 37, the total thrust on shutter 34 alongside changes in the opening of maximum-pressure valve 33 can be made roughly constant, so that the maximum fuel pressure in common rail 3 remains roughly constant alongside changes in engine speed, i.e. in instantaneous flow from high-pressure pump 4.

Preferably, the difference between the diameter of the fuel flow section 38 of the drain channel 32 and the diameter of the calibrated plate 37 is comprised between 0.5 mm and 0.20 mm (normally about 0.35 mm) and the length of the calibrated plate 37 is comprised between 1 mm and 3 mm (normally about 2 mm). For example, the diameter of the fuel flow section 38 of the drain channel 32 can be about 5 mm, the diameter of the calibrated plate 37 can be about 4.65 mm, and the length of the calibrated plate 37 can be about 2 mm.

As shown in FIG. 2, intake channel 17 connects feed line 10 to pumping chamber 14, is regulated by intake valve 18 (at pumping chamber 14), and extends partly inside main body 12. In a preferred embodiment, a compensating chamber 40 along intake channel 17 (i.e. upstream from intake valve 18) houses a number of elastically deformable (or, rather, elastically compressible) compensating bodies 41 for attenuating fluctuating (pulsating) fuel flow along feed line 10. Fuel feed to pumping chamber 14 is extremely irregular, i.e. there are times when fuel flows into pumping chamber 14 (at the intake stage with intake valve 18 open); times when no fuel flows in or out of pumping chamber 14 (at the pumping stage with intake valve 18 closed); and times when fuel flows out of pumping chamber 14 (at the pumping stage with intake valve opened by regulating device 6). This irregularity in fuel feed to pumping chamber 14 is partly attenuated by changes in the volume of compensating bodies 41 in compensating chamber 40, so that fuel flow along feed line 10 is steadier (i.e. still pulsating but to a lesser degree).

A catch chamber 42 is formed in main body 12, underneath pumping chamber 14, and is fitted through with an intermediate portion of piston 15 designed to cyclically alter the volume of catch chamber 42 as it moves back and forth. More specifically, the intermediate portion of piston 15 inside catch chamber 42 is the same shape as the top portion of piston 15 inside pumping chamber 14, so that the movement of piston 15 produces equal but opposite changes in the volumes of catch chamber 42 and pumping chamber 14.

Catch chamber 42 is connected to intake channel 17 by a connecting channel 43 that comes out at intake valve 18; and an annular seal 44 is fitted about a bottom portion of piston 15, underneath catch chamber 42, to prevent fuel leakage along the lateral wall of piston 15. In a preferred embodiment, catch chamber 42 is bounded laterally and at the top by a bottom surface of main body 12, and at the bottom by an annular cap 45 welded laterally to main body 12 and having a central seat housing annular seal 44. Spring 16 is compressed between a bottom wall of annular cap 45 and a top wall of an annular projection 46 integral with the bottom end of piston 15, and is therefore located outside main body 12, where it can be inspected and is completely isolated from the fuel.

One function of catch chamber 42 is to collect inevitable fuel leakage from pumping chamber 14 along the lateral wall of piston 15 at the pumping stage. The fuel leakage collected in catch chamber 42 is then fed from this to pumping chamber 14 along connecting channel 43; and annular seal 44 underneath catch chamber 42 prevents any further fuel leakage from catch chamber 42 along the lateral wall of piston 15. It is important to note that, the fuel in catch chamber 42 being low-pressure, annular seal 44 is not unduly stressed.

Another function of catch chamber 42 is to assist in compensating pulsating fuel flow: when the upstroke of piston 15 reduces the volume of pumping chamber 14, the fuel expelled from pumping chamber 14 through intake valve 18, kept open by regulating device 6, is allowed to flow into catch chamber 42, by virtue of the same upstroke of piston 15 also increasing the volume of catch chamber 42 by the same amount the volume of pumping chamber 14 is reduced. When the upstroke of piston 15 reduces the volume of pumping chamber 14 with intake valve 18 closed, the increase in the volume of catch chamber 42 causes fuel to be sucked into catch chamber 42 from intake channel 17. The downstroke of piston 15 increases the volume of pumping chamber 14 and equally reduces the volume of catch chamber 42, so that the fuel expelled from catch chamber 42 by the reduction in volume of catch chamber 42 is sucked into pumping chamber 14 by the increase in volume of pumping chamber 14.

In other words, fuel is exchanged cyclically between catch chamber 42 (which fills up when piston 15 slides up at the pumping stage, and empties when piston 15 slides down at the intake stage) and pumping chamber 14 (which empties when piston 15 slides up at the pumping stage, and fills up when piston 15 slides down at the intake stage). For optimum fuel exchange between catch chamber 42 and pumping chamber 14, it is vital that the movement of piston 15 produces equal but opposite volume changes in catch chamber 42 and pumping chamber 14.

Cyclic fuel exchange between catch chamber 42 and pumping chamber 14 as described above greatly attenuates pulsating fuel flow along feed line 10. Simulation tests show a possible attenuation of pulsating fuel flow along feed line 10 of over 50% (i.e. pulsation is more than halved as compared with a similar high-pressure pump with no cyclic fuel exchange).

In a preferred embodiment, an overpressure valve 47 is inserted along fuel line 10, downstream from low-pressure pump 8, to drain fuel from feed line 10 into tank 9 when the pressure along feed line 10 exceeds a given threshold value, due to fuel feedback from pumping chamber 14. The function of overpressure valve 47 is to prevent the pressure along feed line 10 from reaching relatively high levels capable of eventually damaging low-pressure pump 8.

High-pressure pump 4 as described has numerous advantages: it is cheap and easy to produce (involving only a few, simple alterations with respect to known high-pressure pumps); features a maximum-pressure valve 33 with a substantially constant work pressure alongside changes in engine speed (i.e. in flow from high-pressure pump 4); and provides for minor pulsating flow along feed line 10.

The invention claimed is:

1. A direct-injection system fuel pump comprising:

at least one pumping chamber;

a piston mounted to slide inside the pumping chamber to cyclically alter the volume of the pumping chamber;

an intake channel connected to the pumping chamber and regulated by an intake valve;

a delivery channel connected to the pumping chamber and regulated by a one-way delivery valve that only permits fuel flow from the pumping chamber;

a drain channel which connects the delivery channel to the pumping chamber and serves as a fuel bleed in the event the fuel in the delivery channel exceeds a given maximum design pressure;

a one-way, maximum-pressure valve, which regulates the drain channel, only permits fuel flow to the pumping chamber, opens when fuel pressure exceeds a threshold value to prevent the fuel in the delivery channel from exceeding the maximum design pressure, and comprises a shutter movable along the drain channel;

a valve seat engaged in fluid tight manner by the shutter;

a spring calibrated to push the shutter into a position engaging the valve seat in fluid tight manner; and a calibrated plate, which produces a local reduction in the fuel flow section of the drain channel;

wherein the calibrated plate is sized so that a hydraulic pressure exerted on the calibrated plate and produced by a load loss astride the calibrated plate roughly equals an increase in the elastic pressure of the spring caused by compression of the spring as the maximum-pressure valve opens; and wherein the hydraulic pressure on the calibrated plate is exerted in the opposite direction to the elastic pressure of the spring, so that, as the opening of the maximum-pressure valve increases, the gradual increase in the elastic pressure of the spring is roughly compensated by a gradual increase in the hydraulic pressure on the calibrated plate.

2. A fuel pump as claimed in claim 1, wherein the difference between the diameter of the fuel flow section of the drain channel and the diameter of the calibrated plate is comprised between 0.5 mm and 0.20 mm and the length of the calibrated plate is comprised between 1 mm and 3 mm.

3. A fuel pump as claimed in claim 1, wherein the total thrust on the shutter remains roughly constant as the opening of the maximum-pressure valve, i.e. the distance between the shutter and the valve seat, increases.

4. A fuel pump as claimed in claim 1, wherein the calibrated plate is interposed between one end of the spring and one side of the shutter.

5. A fuel pump as claimed in claim 4, wherein the calibrated plate rests on both the shutter and the spring.

6. A fuel pump as claimed in claim 5, wherein the calibrated plate has a rod inserted inside the spring.

7. A fuel pump as claimed in claim 1, wherein the intake valve comprises a disk having a number of through holes through which fuel can flow; and a circular deformable plate that rests on one face of the disk to cut off passage through the holes; when fuel flows to the pumping chamber, the deformable plate is deformed and detached from the disk by the fuel to permit fuel flow through the holes; and, when fuel flows from the pumping chamber, the deformable plate is pressed against the disk to seal the holes and so prevent fuel flow through the holes.

8. A fuel pump as claimed in claim 7, further comprising a regulating device connected to the intake valve to keep the intake valve open at the pumping stage of the piston, and so permit fuel flow from the pumping chamber along the intake channel; the regulating device comprises a control rod connected to the deformable plate of the intake valve, and movable between a passive position allowing the deformable plate to engage the disk in fluidtight manner to seal the holes, and an active position preventing the deformable plate from engaging the disk in fluidtight manner, thus opening the holes.

9. A fuel pump as claimed in claim 1, further comprising a compensating chamber located along the intake channel and housing at least one elastically deformable compensating body for attenuating pulsating fuel flow.

10. A fuel pump as claimed in claim 1, further comprising:

a catch chamber located underneath the pumping chamber and fitted through with an intermediate portion of the piston, which intermediate portion is designed to cyclically alter the volume of the catch chamber as its moves back and forth; and a connecting channel connecting the catch chamber to the intake channel.

11. A fuel pump as claimed in claim 10, wherein the intermediate portion of the piston inside the catch chamber is the same shape as the top portion of the piston inside the pumping chamber, so that, when the piston moves, the change in volume of the catch chamber produced by movement of the piston is equal to and opposite the change in volume of the pumping chamber produced by movement of the piston.

12. A fuel pump as claimed in claim 10, wherein the connecting channel comes out at the intake valve.

13. A fuel pump as claimed in claim 10, further comprising, underneath the catch chamber, an annular seal is fitted about a bottom portion of the piston to prevent fuel leakage along the lateral wall of the piston.

14. A direct-injection system fuel pump, comprising:

at least one pumping chamber;

a piston mounted to slide inside the pumping chamber to cyclically alter the volume of the pumping chamber;

an intake channel connected to the pumping chamber and regulated by an intake valve, the intake valve comprising:

a disk having a number of through holes through which fuel can flow; and a circular deformable plate that rests on one face of the disk to cut off passage through the holes; when fuel flows to the pumping chamber, the deformable plate is deformed and detached from the disk by the fuel to permit fuel flow through the holes; and, when fuel flows from the pumping chamber, the deformable plate is pressed against the disk to seal the holes and so prevent fuel flow through the holes;

a delivery channel connected to the pumping chamber and regulated by a one-way delivery valve that only permits fuel flow from the pumping chamber;

a drain channel connecting the delivery channel to the pumping chamber and serving as a fuel bleed;

a one-way, maximum-pressure valve which opens when fuel pressure exceeds a threshold value, and comprises a shutter movable along the drain channel;

a valve seat engaged in fluid tight manner by the shutter;

a spring calibrated to push the shutter into a position engaging the valve seat in fluid tight manner; and a calibrated plate, which produces a local reduction in the fuel flow section of the drain channel; and wherein the calibrated plate is sized so that a hydraulic pressure exerted on the calibrated plate and produced by a load loss astride the calibrated plate roughly equals an increase in the elastic pressure of the spring caused by compression of the spring as the maximum-pressure valve opens; and wherein the hydraulic pressure on the calibrated plate is exerted in the opposite direction to the elastic pressure of the spring, so that, as the opening of the maximum-pressure valve increases, the gradual increase in the elastic pressure of the spring is roughly compensated by a gradual increase in the hydraulic pressure on the calibrated plate.

15. A fuel pump as claimed in claim 14, further comprising a regulating device connected to the intake valve to keep the intake valve open at the pumping stage of the piston, and so permit fuel flow from the pumping chamber along the intake channel; the regulating device comprises a control rod connected to the deformable plate of the intake valve, and movable between a passive position allowing the deformable plate to engage the disk in fluid tight manner to seal the holes, and an active position preventing the deformable plate from engaging the disk in fluid tight manner, thus opening the holes.

16. A direct-injection system fuel pump, comprising:

at least one pumping chamber;

a piston mounted to slide inside the pumping chamber to cyclically alter the volume of the pumping chamber;

an intake channel connected to the pumping chamber and regulated by an intake valve;

a delivery channel connected to the pumping chamber and regulated by a one-way delivery valve that permits fuel flow from the pumping chamber;

a drain channel connecting the delivery channel to the pumping chamber and serving as a fuel bleed;

a one-way, maximum-pressure valve which opens when fuel pressure exceeds a threshold value, and comprises a shutter movable along the drain channel;

a valve seat engaged in fluid tight manner by the shutter; a spring calibrated to push the shutter into a position engaging the valve seat in fluid tight manner; and a calibrated plate, which produces a local reduction in the fuel flow section of the drain channel;

a catch chamber located underneath the pumping chamber and fitted through with an intermediate portion of the piston, which intermediate portion is designed to cyclically alter the volume of the catch chamber as its moves back and forth;

a connecting channel connecting the catch chamber to the intake channel; and wherein the calibrated plate is sized so that a hydraulic pressure exerted on the calibrated plate and produced by a load loss astride the calibrated plate roughly equals an increase in the elastic pressure of the spring caused by compression of the spring as the maximum-pressure valve opens; and wherein the hydraulic pressure on the calibrated plate is exerted in the opposite direction to the elastic pressure of the spring, so that, as the opening of the maximum-pressure valve increases, the gradual increase in the elastic pressure of the spring is roughly compensated by a gradual increase in the hydraulic pressure on the calibrated plate.

17. A fuel pump as claimed in claim 16, wherein the intermediate portion of the piston inside the catch chamber is the same shape as the top portion of the piston inside the pumping chamber, so that, when the piston moves, the change in volume of the catch chamber produced by movement of the piston is equal to and opposite the change in volume of the pumping chamber produced by movement of the piston.

18. A fuel pump as claimed in claim 16, wherein the connecting channel comes out at the intake valve.

19. A fuel pump as claimed in claim 16, further comprising, underneath the catch chamber, an annular seal is fitted about a bottom portion of the piston to prevent fuel leakage along the lateral wall of the piston.

* * * * *